US008584916B1

(12) United States Patent
Chen

(10) Patent No.: US 8,584,916 B1
(45) Date of Patent: Nov. 19, 2013

(54) ROTATABLE SECURING DEVICE

(71) Applicant: Inno Designer International Co., Ltd., Tai Ping (TW)

(72) Inventor: Yi-Ying Chen, Tai Ping (TW)

(73) Assignee: Inno Designer International Co., Ltd., Tai Ping, Taichung (TW)

( * ) Notice: Subject to any disclaimer, the term of this patent is extended or adjusted under 35 U.S.C. 154(b) by 0 days.

(21) Appl. No.: 13/628,037

(22) Filed: Sep. 26, 2012

(51) Int. Cl.
*A45F 5/00* (2006.01)

(52) U.S. Cl.
USPC ..... 224/199; 224/666; 224/679; 224/904

(58) Field of Classification Search
USPC ..... 224/197, 198, 199, 200, 666, 668, 669, 224/679, 904
See application file for complete search history.

(56) References Cited

U.S. PATENT DOCUMENTS 3,811,715 A * 5/1974 Brudy ..... 403/93
4,549,483 A * 10/1985 Makley ..... 101/45
4,785,190 A * 11/1988 Frankena ..... 250/503.1
5,190,390 A * 3/1993 Ming-Tai ..... 403/24
5,806,146 A * 9/1998 Chen ..... 24/3.11
5,833,100 A * 11/1998 Kim ..... 224/197
6,029,871 A * 2/2000 Park ..... 224/197
6,311,941 B1 * 11/2001 Feldmeyer ..... 248/188.8
6,443,340 B1 * 9/2002 Chung et al. ..... 224/197
6,637,631 B2 * 10/2003 Lafoux et al. ..... 224/197
6,802,328 B2 * 10/2004 Lin ..... 135/96
6,915,900 B2 * 7/2005 Chen ..... 206/350
7,478,776 B2 * 1/2009 Salentine et al. ..... 242/379
7,699,176 B2 * 4/2010 Lin ..... 206/759
8,328,055 B1 * 12/2012 Snyder ..... 224/197
8,333,310 B2 * 12/2012 Tages ..... 224/197
2006/0196902 A1 * 9/2006 Chen et al. ..... 224/197
2006/0237495 A1 * 10/2006 Chen et al. ..... 224/197
2009/0001116 A1 * 1/2009 Meng ..... 224/666
2010/0288804 A1 * 11/2010 Youssefi-Shams et al. ... 224/199

* cited by examiner

*Primary Examiner* — Justin Larson

(57) ABSTRACT

A rotatable securing device for a tool box has a casing, a securing unit and a locking unit. The casing has a locking recess, the locking recess is provided with an opening at a middle area, and a plurality of engaging grooves and a first contacting face are evenly disposed on a circumference of the locking recess. The securing unit respectively has a supporting surface at an upper end and a lower end, and a fastening rib respectively disposed at two sides of the two supporting surfaces. The locking unit is a flat disk; the locking unit has an engaging face corresponding to the fastening rib, a plurality of positioning protrusions disposed on its edge, at least one the elastic slot adjacent to the positioning protrusion, and a second contacting face for in contact with the supporting surface.

3 Claims, 6 Drawing Sheets

3–3

ROTATABLE SECURING DEVICE

BACKGROUND OF THE INVENTION

1. Field of the Invention

The present invention relates to a rotatable securing device, and in particular to a rotatable securing device for a tool box.

2. Description of the Related Art

Currently, typical tool boxes are used for storing various tool bits. However, to make the tool box to be more portable is a necessary solution. A common design is a tool box with a detachable buckle which can be attached to a user. But existing buckle design is difficult to assemble. Therefore, it is desirable to provide a rotatable securing device for a tool box to mitigate and/or obviate the aforementioned problems.

SUMMARY OF THE INVENTION

An objective of the present invention is to provide a rotatable securing device for a tool box which can be rotated easily and provide secured positioning In order to achieve the above-mentioned objective, A rotatable securing device for a tool box has a casing, a securing unit and a locking unit. The casing has a locking recess, the locking recess is provided with an opening at a middle area, and a plurality of engaging grooves and a first contacting face are evenly disposed on a circumference of the locking recess. The securing unit respectively has a supporting surface at an upper end and a lower end, and a fastening rib respectively disposed at two sides of the two supporting surfaces. The locking unit is a flat disk; the locking unit has an engaging face corresponding to the fastening rib, a plurality of positioning protrusions disposed on its edge, at least one the elastic slot adjacent to the positioning protrusion, and a second contacting face for in contact with the supporting surface.

Other objects, advantages, and novel features of the invention will become more apparent from the following detailed description when taken in conjunction with the accompanying drawings.

DETAILED DESCRIPTION OF THE PREFERRED EMBODIMENT

Please refer to FIG. 1 to FIG. 6. In a preferred embodiment of the present invention, a rotatable securing device a casing 10, a securing unit 20 and a locking unit 30.

Figure 1:
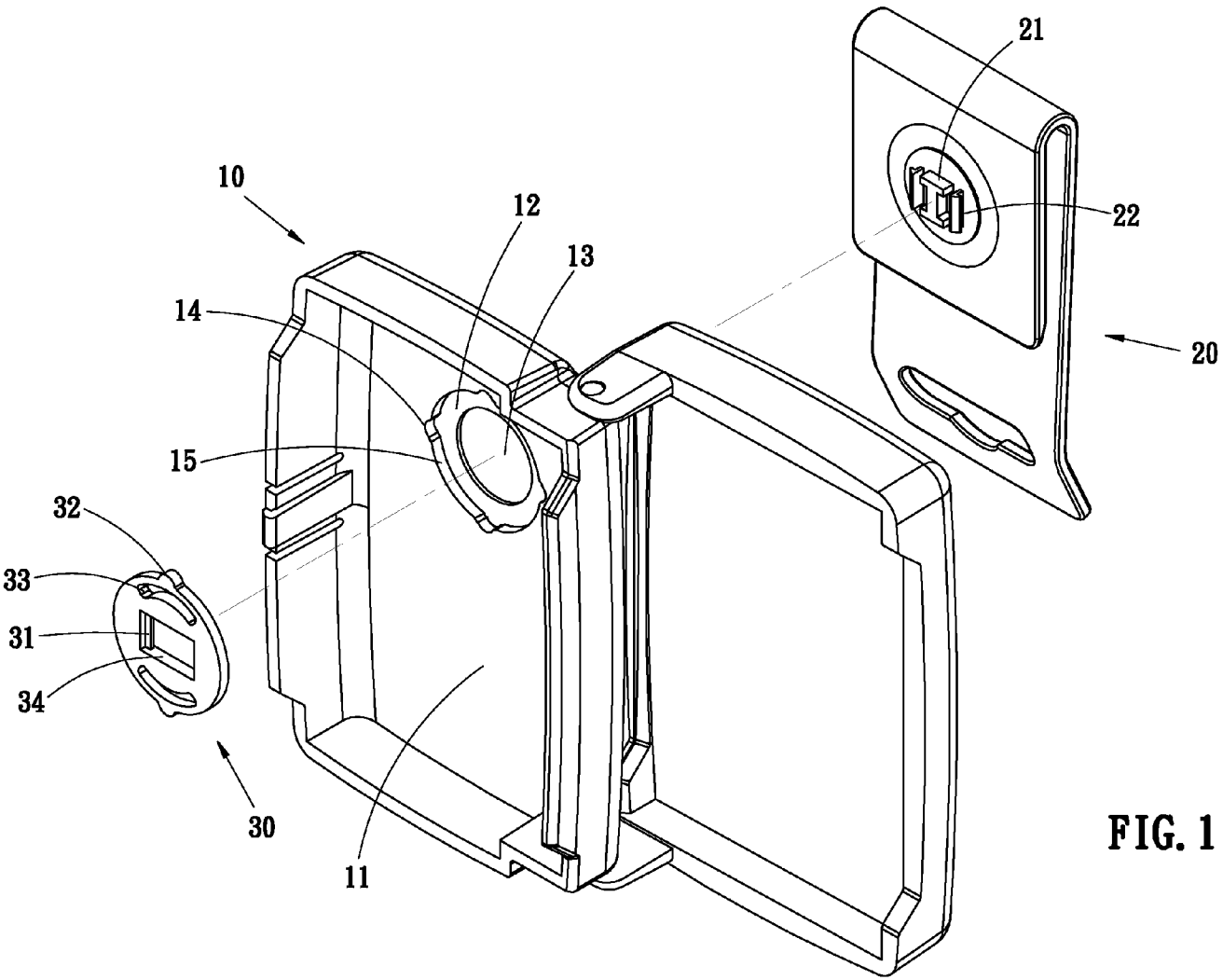
FIG. 1 is a perspective exploded view of an embodiment of the present invention.

As shown in FIG. 1, the casing 10 has a left portion and a right portion, the casing 10 has a container space 11 and a locking recess 12. The locking recess has a disc-like shape. The locking recess 12 is disposed in the container space 11 and has an opening 13 for accepting the securing unit 20 at a middle area. Furthermore, there are a plurality of engaging grooves 14 and a first contacting face 15 are evenly disposed on a circumference of the locking recess 12.

Figure 2:
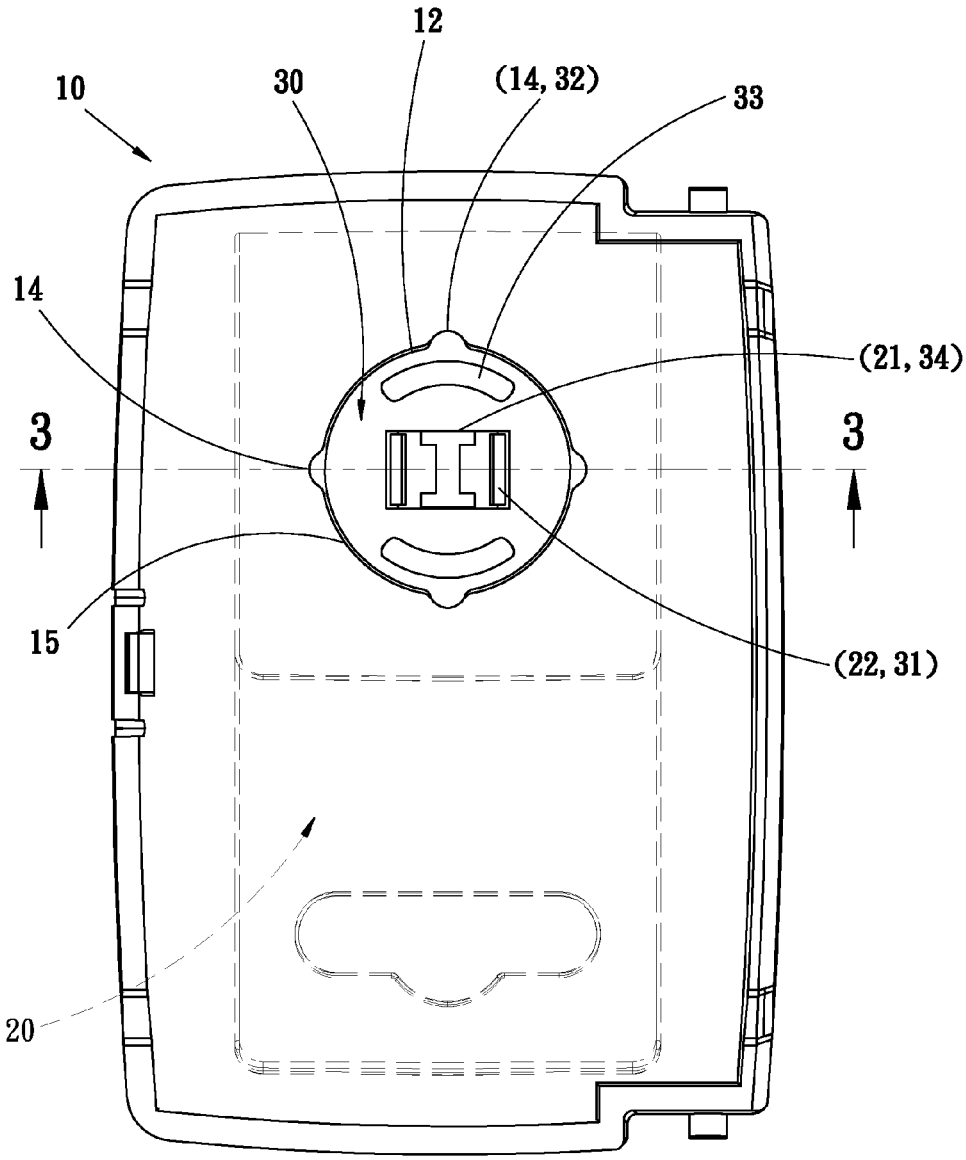
FIG. 2 is a schematic view of the embodiment of the present invention.
Figure 3:
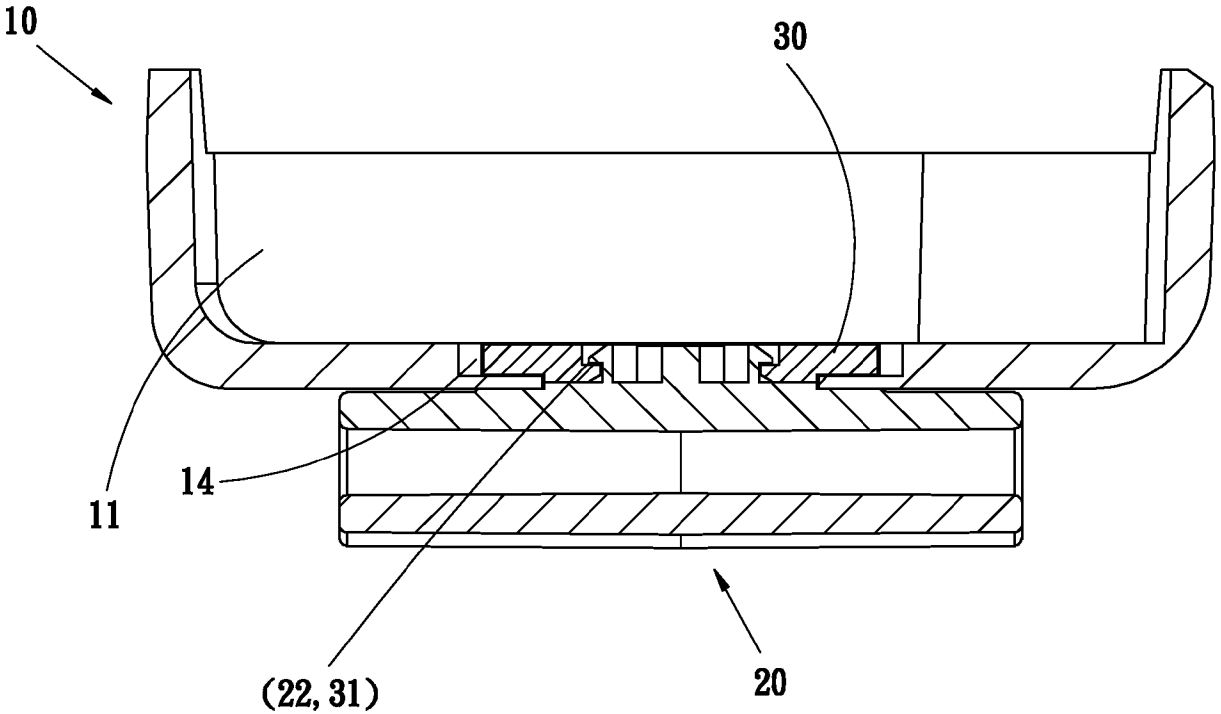
FIG. 3 is a local detail view of the embodiment of the present invention shown in FIG. 2.

As shown in FIG. 1 to FIG. 3, the securing unit 20 respectively has a supporting surface 21 at an upper end and a lower end, and a fastening rib 22 respectively disposed at two sides of the two supporting surfaces 21. When the fastening ribs 22 engage with the engaging face 31 of the locking unit 30, the casing 10 is pivoted between the securing unit 20 and the locking unit 30, such that the fastening rib 22 and the engaging face 31 engages with each other and the is able to rotate around the opening 13.

Figure 4:
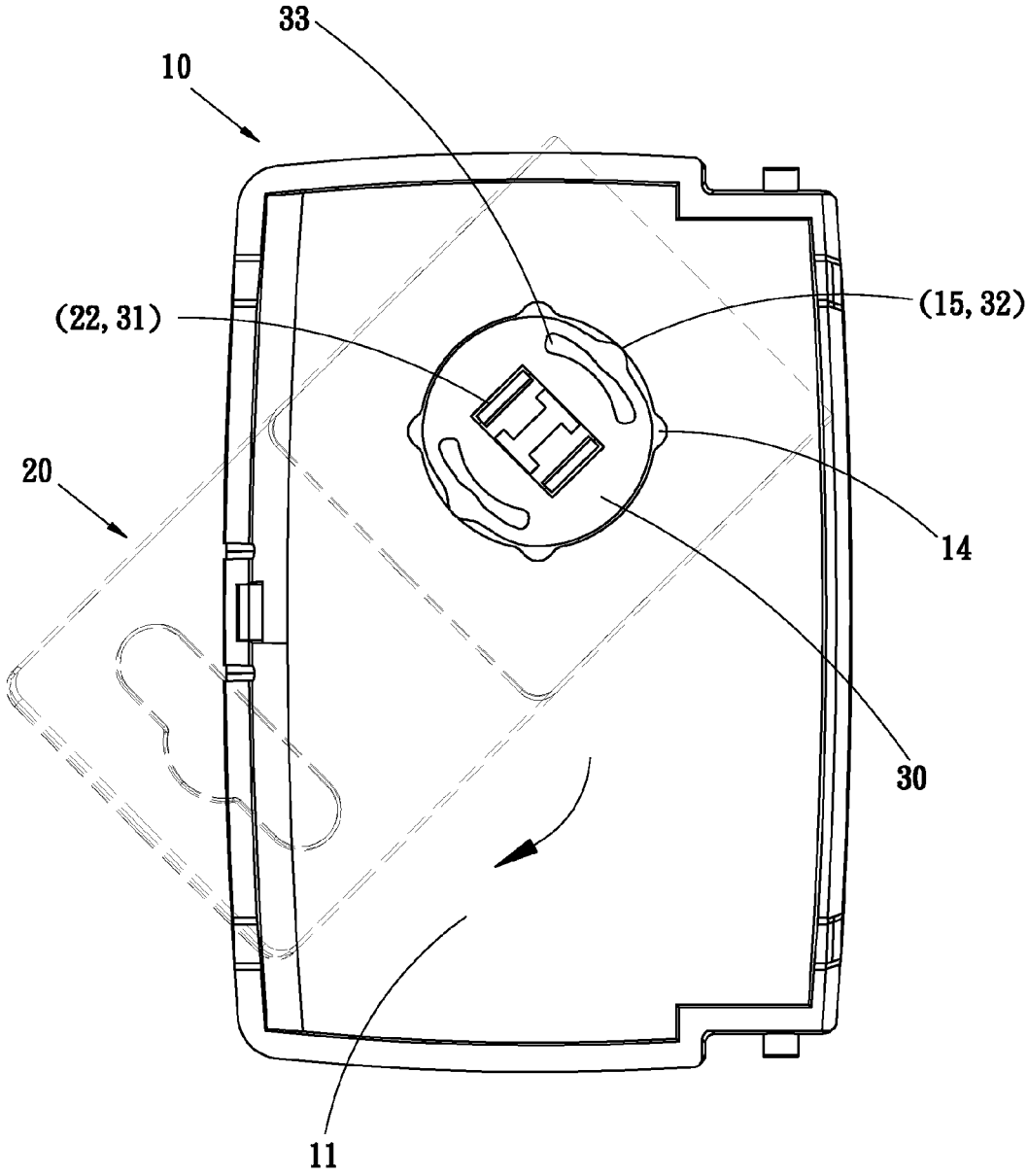
FIG. 4 is a schematic drawing showing the elastic slot is deformed according to the embodiment of the present invention.
Figure 5:
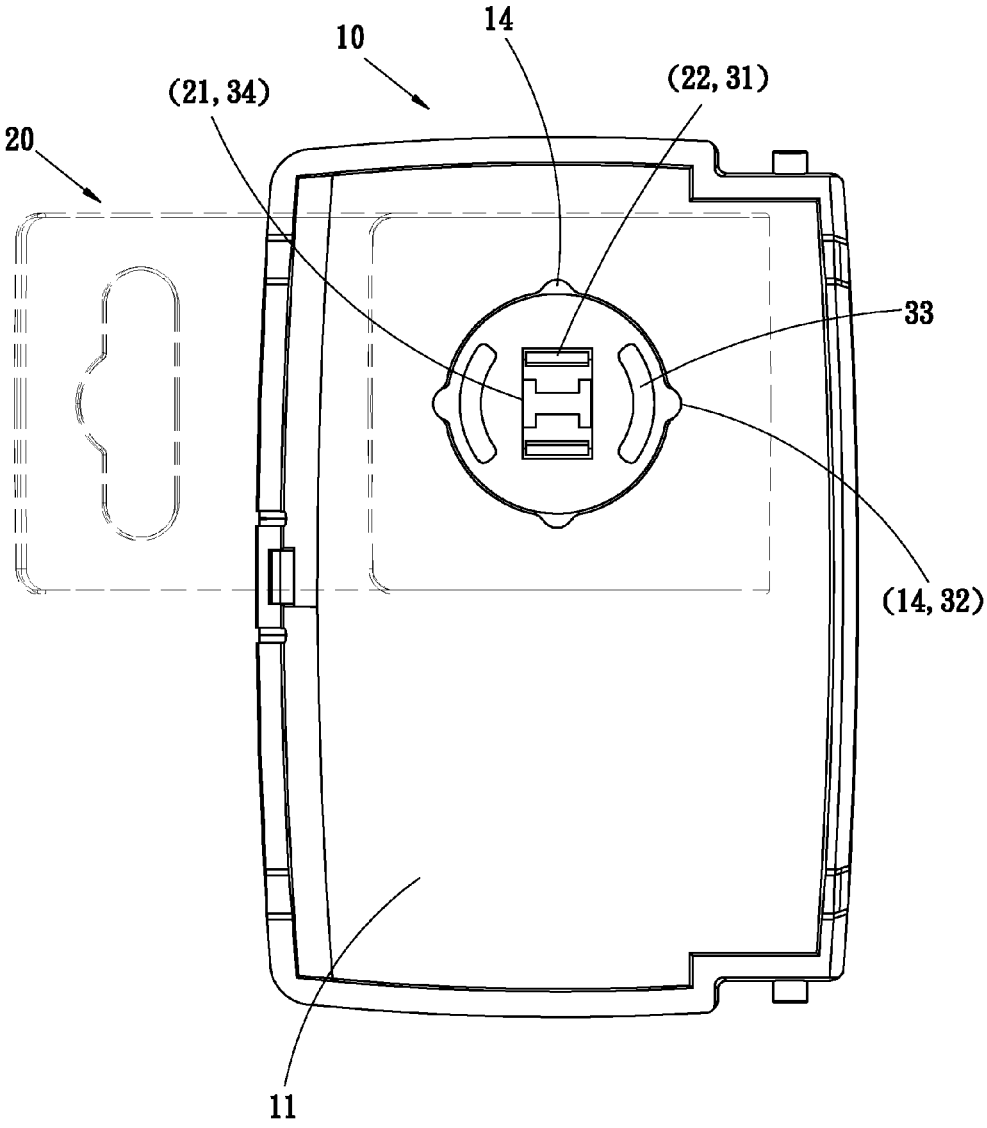
FIG. 5 is a schematic drawing showing the rotatable securing device being rotated to a different angle.
Figure 6:
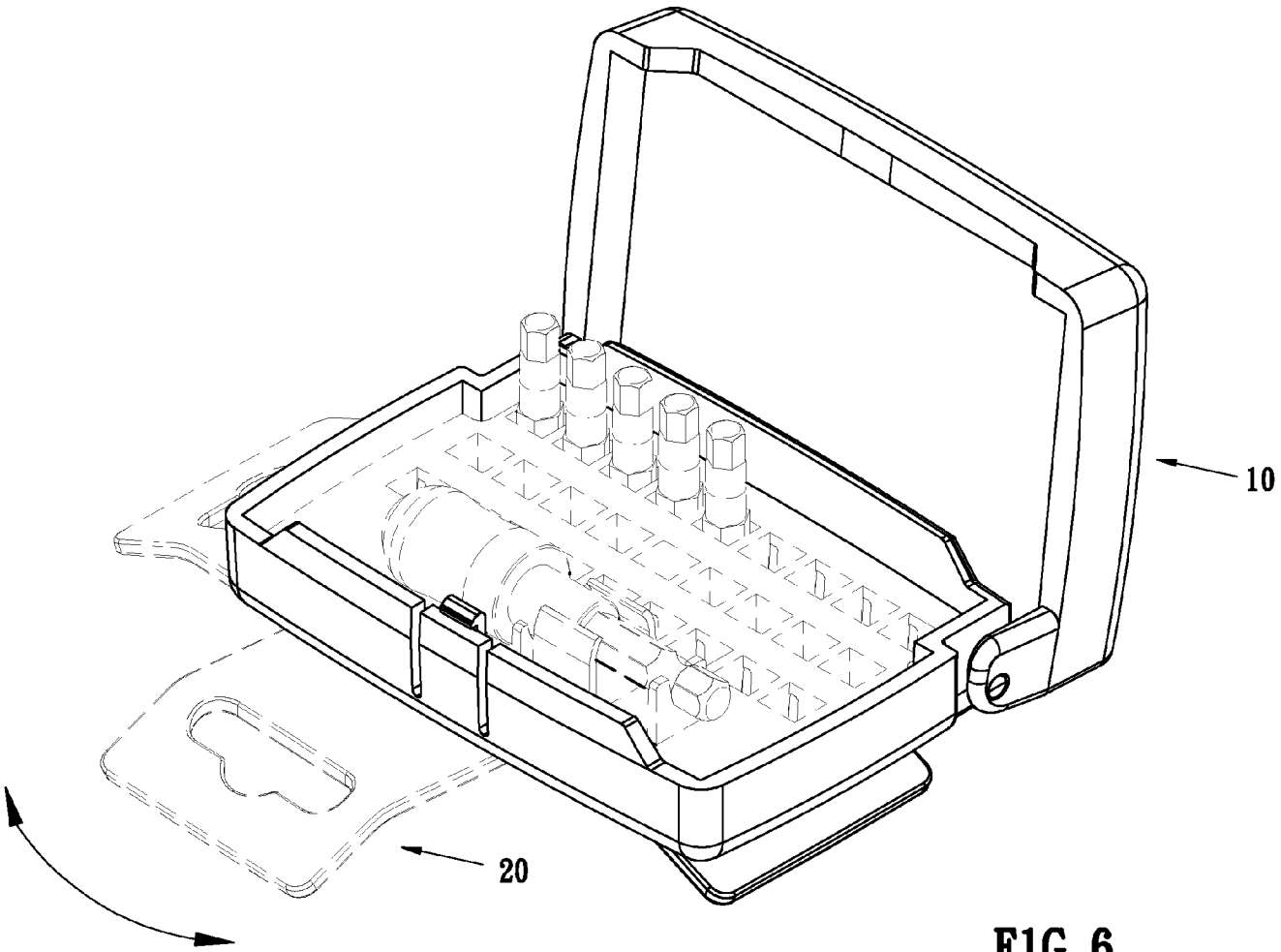
FIG. 6 is another schematic drawing showing the rotatable securing device being rotated according to the embodiment of the present invention.

Please refer to FIG. 1 to FIG. 5, when the locking unit 30 is mounted onto the locking recess 12, the locking unit 30 is a flat disk and made of elastic plastic material. The locking unit 30 comprises an engaging face 31, a positioning protrusion 32, an elastic slot 33 and a second contacting face 34. The engaging face 31 engages with the fastening rib 22 of the securing unit 20, the supporting surface 21 makes contact with the second contacting face 34, such that the locking unit 30 is locked in the locking recess 12 of the casing 10 and the positioning protrusion 32 inserts into the engaging groove 14 of the casing 10 (as shown in FIG. 2). When the positioning protrusion 32 engages with the engaging groove 14, the elastic slot 33 adjacent to the positioning protrusion 32 is compressed when the securing unit 20 is rotated because the positioning protrusion 32 makes the first contacting face 15 to push the elastic slot 33 (as shown in FIG. 4). When the positioning protrusion 32 is rotated to engage with the next engaging groove 14 (as shown in FIG. 5), the casing 10 is also rotated and positioned.

With the engaging face 31 of the securing unit 30 engages with the fastening rib 22 of the locking unit 20, the casing 10 can be rotated around the opening 13; when the positioning protrusion 32 of the locking unit 30 engages with the engaging groove 14 of the casing 10, the casing 10 can be securely positioned. The user can utilizes the securing unit 20 to attach the casing 10 on a belt. Moreover, the casing 10 is securely locked with the securing unit 20 and the locking unit 30, there is no need for another securing elements or screws.

Although the present invention has been explained in relation to its preferred embodiment, it is to be understood that many other possible modifications and variations can be made without departing from the spirit and scope of the invention as hereinafter claimed.

What is claimed is:

1. A rotatable securing device for a tool box comprising a casing, a securing unit and a locking unit, wherein:

the casing has a locking recess, the locking recess provided with an opening at a middle area, a first contacting face comprising a plurality of engaging grooves disposed on a circumference of the locking recess;

the securing unit is attached to a clip configured to attach to a belt and has a respective supporting surface at each of an upper end and a lower end, and a fastening rib respectively disposed on opposing sides of the two supporting surfaces and spaced from the two supporting surfaces;

the locking unit is a flat disk configured to set within the locking recess; the locking unit having opposed engaging faces corresponding to the fastening ribs, at least a positioning protrusion disposed on an edge of the locking unit, at least one corresponding elastic slot adjacent to the positioning protrusion, and opposing second contacting faces for contacting with and corresponding to the supporting surfaces;

when the engaging face engages with the fastening rib, the supporting surfaces and the second contacting faces make contact with each other, such that the locking unit engages within the locking recess, the positioning protrusion fits into one of the engaging grooves, and when the locking unit is rotated, the positioning protrusion is rotated away from the engaging groove, causing the elastic slot to deform.

2. The rotatable securing device as claimed in claim 1, wherein the locking recess corresponds to the locking unit.

3. The rotatable securing device as claimed in claim 1, wherein the locking unit is made of an elastic plastic material.

* * * * *